US007069609B2

(12) United States Patent
Zheng

(10) Patent No.: US 7,069,609 B2
(45) Date of Patent: Jul. 4, 2006

(54) INFLATABLE LIQUID FURNITURE

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 10/970,246

(22) Filed: Oct. 20, 2004

(65) Prior Publication Data

US 2006/0080781 A1 Apr. 20, 2006

(51) Int. Cl.
*A47C 27/10* (2006.01)

(52) U.S. Cl. ..... 5/654; 5/644; 5/681; 5/687

(58) Field of Classification Search ..... 5/654, 5/655.3, 655.5, 644, 706, 710, 665, 678–681, 5/685–687
See application file for complete search history.

(56) References Cited

U.S. PATENT DOCUMENTS

| | | | | | |
|---|---|---|---|---|---|
| 1,324,009 | A | | 12/1919 | Hope | 5/413 R |
| 1,648,373 | A | | 11/1927 | Vilas | 5/413 R |
| 2,620,493 | A | | 12/1952 | Breisford | 5/700 |
| 2,623,574 | A | | 12/1952 | Damsch | 297/111 |
| 3,456,270 | A | * | 7/1969 | Weinstein et al. | 5/665 |
| 3,572,836 | A | * | 3/1971 | Khanh | 297/452.41 |
| 3,722,012 | A | * | 3/1973 | Tobinick et al. | 5/665 |
| 3,736,604 | A | * | 6/1973 | Carson, Jr. | 5/422 |
| 3,751,741 | A | | 8/1973 | Hendry | 5/413 AM |
| 3,766,579 | A | * | 10/1973 | Shields | 5/681 |
| 3,778,852 | A | * | 12/1973 | Penn et al. | 5/422 |
| 3,787,907 | A | * | 1/1974 | Pennington et al. | 5/687 |
| 3,798,686 | A | | 3/1974 | Gaiser | 5/413 AM |
| 3,802,004 | A | * | 4/1974 | Whitney | 5/687 |
| 3,803,647 | A | * | 4/1974 | Reswick | 5/676 |
| 3,842,455 | A | * | 10/1974 | Whitney | 5/687 |
| 3,918,110 | A | * | 11/1975 | Cantillo et al. | 5/687 |
| 3,925,835 | A | * | 12/1975 | Pennington et al. | 5/687 |
| 3,983,587 | A | * | 10/1976 | Gorran | 5/654 |
| 4,006,501 | A | * | 2/1977 | Phillips | 5/687 |
| 4,012,269 | A | * | 3/1977 | Tabata et al. | 156/251 |
| 4,038,712 | A | * | 8/1977 | Miller | 5/687 |
| 4,055,867 | A | * | 11/1977 | Phillips | 5/687 |
| 4,065,819 | A | * | 1/1978 | Gorran | 5/681 |
| 4,068,335 | A | * | 1/1978 | Phillips | 5/687 |
| 4,078,960 | A | * | 3/1978 | Phillips | 156/227 |
| 4,079,473 | A | * | 3/1978 | Phillips | 5/687 |
| 4,080,676 | A | * | 3/1978 | Calleance | 5/687 |
| 4,092,750 | A | | 6/1978 | Ellis | 5/413 AM |
| 4,094,025 | A | * | 6/1978 | Nystad | 5/665 |
| 4,097,717 | A | * | 6/1978 | Phillips | 219/217 |
| 4,101,995 | A | * | 7/1978 | Phillips | 5/687 |
| 4,121,310 | A | * | 10/1978 | Gorran | 5/678 |
| 4,150,447 | A | * | 4/1979 | Miller | 5/687 |
| 4,187,569 | A | * | 2/1980 | Calleance | 5/687 |
| 4,193,151 | A | * | 3/1980 | Calleance | 5/681 |
| 4,241,465 | A | | 12/1980 | Yarimie et al. | 5/682 |
| 4,245,364 | A | * | 1/1981 | Calleance | 5/680 |
| 4,292,701 | A | * | 10/1981 | Woychick | 5/422 |
| 4,349,926 | A | * | 9/1982 | Winther | 5/687 |

(Continued)

FOREIGN PATENT DOCUMENTS

GB 2166343 5/1996

*Primary Examiner*—Robert G. Santos
(74) *Attorney, Agent, or Firm*—Raymond Sun

(57) ABSTRACT

An apparatus has a first section having a hollow interior that is filled with air, and a second section attached to the top of the first section and having a hollow interior that retains a liquid.

13 Claims, 12 Drawing Sheets

U.S. PATENT DOCUMENTS 4,370,769 A * 2/1983 Herzig et al. ..... 5/654
4,389,742 A * 6/1983 DeWitt ..... 5/654
4,459,714 A * 7/1984 Lin ..... 5/655.3
4,491,993 A * 1/1985 Santo ..... 5/678
4,501,036 A * 2/1985 Santo ..... 5/687
4,513,463 A * 4/1985 Santo ..... 5/681
4,534,078 A * 8/1985 Viesturs et al. ..... 5/681
4,575,884 A 3/1986 Jamerson et al. ..... 5/420
4,604,765 A 8/1986 Schultz ..... 5/413 AM
4,637,082 A 1/1987 Moore et al. ..... 5/681
4,638,518 A * 1/1987 Barbulla ..... 5/687
4,663,790 A * 5/1987 Santo ..... 5/681
4,724,560 A * 2/1988 Christie ..... 5/644
4,727,607 A * 3/1988 Nystad ..... 5/678
RE32,665 E * 5/1988 Santo ..... 5/680
4,757,832 A 7/1988 Russell ..... 135/128
4,856,131 A 8/1989 Mills ..... 5/413 R
4,901,386 A * 2/1990 Lane ..... 5/687
4,945,588 A * 8/1990 Cassidy et al. ..... 5/665
4,970,743 A 11/1990 Wride et al. ..... 5/679
4,972,533 A 11/1990 Brown ..... 5/413 R
4,991,244 A 2/1991 Walker ..... 5/400
5,005,236 A 4/1991 Hutchinson ..... 5/413 AM
5,044,030 A * 9/1991 Balaton ..... 5/710
5,065,465 A * 11/1991 Nystad ..... 5/680
5,072,468 A * 12/1991 Hagopian ..... 5/665
5,072,469 A * 12/1991 Boyd ..... 5/665
5,107,557 A * 4/1992 Boyd ..... 5/665
5,115,526 A 5/1992 Boyd et al. ..... 5/680
5,163,197 A 11/1992 Armstrong et al. ..... 5/663
5,203,040 A 4/1993 Hochschild, III ..... 5/680
5,311,623 A * 5/1994 Hendi ..... 5/685
5,331,696 A 7/1994 Armstrong et al. ..... 5/669
5,421,045 A 6/1995 Bowen ..... 5/485
5,471,687 A 12/1995 Vierra ..... 5/413 AM
5,515,560 A 5/1996 Strobel ..... 5/680
5,528,779 A 6/1996 Lee et al. ..... 5/413 AM
5,535,463 A * 7/1996 Chiu ..... 5/681
5,548,858 A 8/1996 Shoa ..... 5/413 R
5,553,339 A 9/1996 Thomas ..... 5/413 AM
5,557,813 A 9/1996 Steed et al. ..... 5/739
5,560,056 A 10/1996 Tai ..... 5/120
5,632,051 A 5/1997 Stanley et al. ..... 5/636
5,640,725 A 6/1997 Ando et al. ..... 5/413 AM
5,642,544 A * 7/1997 Munoz ..... 5/644
5,669,091 A * 9/1997 Chung ..... 5/687
5,735,003 A 4/1998 Judge ..... 5/413 AM
5,740,565 A 4/1998 McDade ..... 5/413 AM
5,901,392 A * 5/1999 Hsieh ..... 5/681
5,991,948 A 11/1999 Stanley et al. ..... 5/709
6,042,186 A 3/2000 Kojic et al. ..... 297/452.41
6,128,794 A 10/2000 Pariseau ..... 5/413 R
6,128,795 A 10/2000 Stanley et al. ..... 5/421
6,243,893 B1 * 6/2001 Baldwin ..... 5/422
6,321,400 B1 11/2001 Gulino ..... 5/413 AM
6,343,393 B1 * 2/2002 Chow ..... 5/681
6,364,782 B1 4/2002 Ochi ..... 472/134
6,397,415 B1 * 6/2002 Hsieh ..... 5/644
D461,356 S 8/2002 Thomas ..... D6/610
6,491,717 B1 12/2002 Stanley et al. ..... 607/108
6,553,591 B1 * 4/2003 Motosko ..... 5/655.5
6,671,910 B1 * 1/2004 Hsu et al. ..... 5/710
6,684,429 B1 2/2004 Deering ..... 5/644
6,857,152 B1 * 2/2005 Chow ..... 5/681
2002/0078501 A1 6/2002 Lamke ..... 5/413 AM
2002/0104162 A1 8/2002 Stewart ..... 5/413 AM
2003/0101516 A1 * 6/2003 Hsu et al. ..... 5/710

* cited by examiner

INFLATABLE LIQUID FURNITURE

BACKGROUND OF THE INVENTION

1. Field of the Invention

The present invention relates to inflatable furniture, and in particular, to inflatable furniture having chambers filled with liquid.

2. Description of the Prior Art

Portable furniture, such as sofas, chairs, mattresses, sleeping bags, sleeping mats, futons and similar products have become very popular in recent times. Some of these furniture items are inflatable, which renders them more convenient for use because they can be deflated to a smaller profile for storage or transportation.

Unfortunately, these inflatable furniture items are not very comfortable. For example, inflatable mattresses provide a firm base for the user to sleep on, but is not very comfortable because a fully inflated mattress is very firm and does not conform to the user's body. Specifically, the inner chamber of a fully inflatable mattress is completely filled with air so that the surfaces of the mattress are not compliant to a user's body.

Thus, there still remains a need to provide portable furniture which is comfortable for the user, convenient to use, and easy to store.

SUMMARY OF THE DISCLOSURE

It is an object of the present invention to provide portable furniture which is comfortable for the user.

It is another object of the present invention to provide portable furniture that is convenient to use and easy to store.

In order to accomplish the objects of the present invention, the present invention provides an apparatus having a first section having a hollow interior that is filled with air, and a second section attached to the top of the first section and having a hollow interior that retains a liquid.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
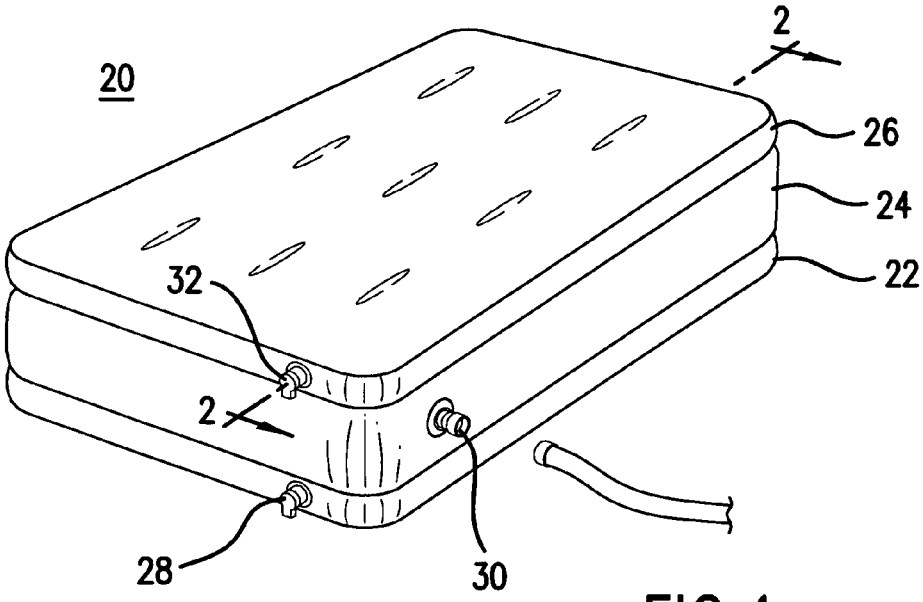
FIG. 1 is a perspective view of a portable bedding apparatus according to one embodiment of the present invention.
Figure 2:
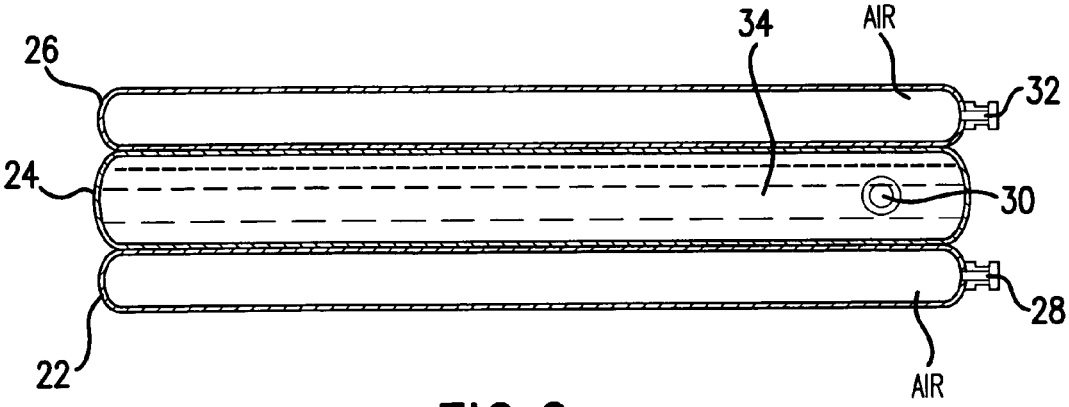
FIG. 2 is a cross-sectional view of the apparatus of FIG. 1 taken along lines 2—2 thereof.

FIGS. 1 and 2 illustrate a portable bedding apparatus 20 according to one embodiment of the present invention. The apparatus 20 has a base section 22, a middle section 24 and a top section 26. The base section 22 can be an inflatable chamber having an inlet/outlet 28 through which air can pass. The middle section 24 can be a hollow chamber having an inlet/outlet 30 through which a liquid (e.g., water) can pass. The top section 26 can also be an inflatable chamber having an inlet/outlet 32 through which air can pass. Thus, the top and bottom sections 26, 22 can be filled with air, while the middle section 24 can be filled with a liquid 34. The three sections 22, 24, 26 can be sized and configured so that the apparatus 20 will appear to be a unitary structure; for example, the sections 22, 24, 26 can have the same size and shape. The sections 22 and 26 are inflatable, and are made from an inflatable material (e.g., plastic, PVC, leather and nylon) that has an interior chamber for receiving air or fluid that is introduced through an air inlet 26. Another example of a possible material for the sections 22 and 26 is a soft fabric that is lined with a plastic coating. In this regard, each section 22 and 26 can be similar to a conventional inflatable mattress. The middle section 24 can be made of a soft and flexible material that is adapted to hold liquids (e.g., plastics, PVC, etc.). Each section 22, 24, 26 can be irremovably secured to an adjacent section 22, 24, 26 (e.g., by heat fusing, glue, and similar techniques), or removably secured to an adjacent section 22, 24, 26 (e.g., by VELCRO™ pads, ties, loops and similar devices).

The apparatus 20 can be used like a conventional mattress, with the added benefit that the middle section 24 provides a more comfortable support for the back and body. In this regard, the middle section 24 is filled with a liquid, which readily conforms to the user's body. However, if the middle section 34 is large, the large mass of liquid inside the middle section 34 may cause the middle section 24 to be very wavy and possibly uncomfortable (in other words, almost like sleeping on a water bed). Therefore, providing a thin top section 26 that is filled with air on top of the conforming middle section 24 firms up the liquid effect of the middle section 24 to provide a more comfortable sleeping surface. The thickness and volume of the chambers inside the sections 22, 24, 26 can be varied to adjust the desired firmness of the bedding apparatus 20. For example, providing a smaller volume middle section 24 with a larger volume top section 26 would provide a firmer sleeping surface.

Figure 3:
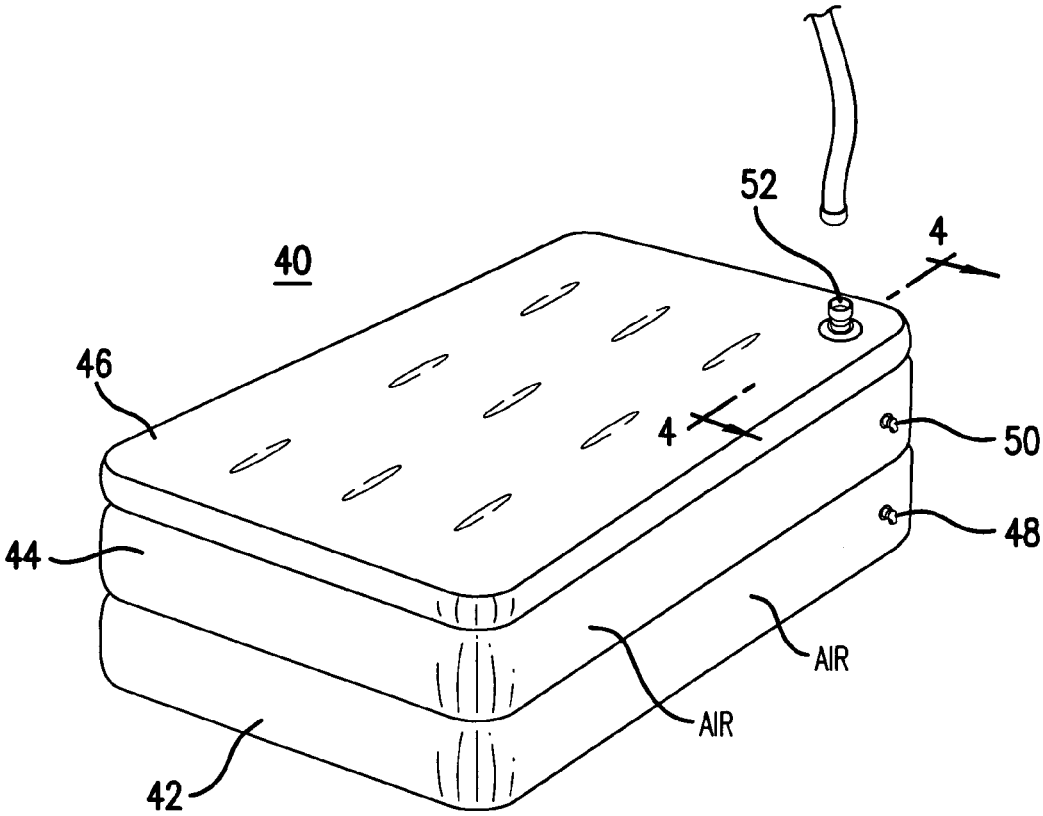
FIG. 3 is a perspective view of a portable bedding apparatus according to another embodiment of the present invention.
Figure 4:
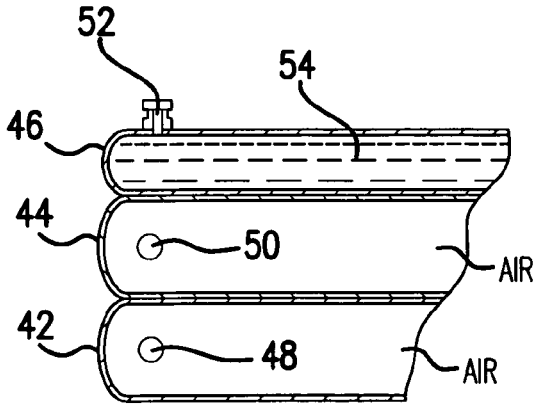
FIG. 4 is a cross-sectional view of the apparatus of FIG. 3 taken along lines 4—4 thereof.

FIGS. 3 and 4 illustrate another portable bedding apparatus 40 according to another embodiment of the present invention. The apparatus 40 is similar to the apparatus 20 in FIGS. 1 and 2 and applies the same principles as the apparatus 20 in FIGS. 1 and 2, but the configurations have been modified to provide different functionalities and results. The apparatus 40 has a base section 42, a middle section 44 and a top section 46. The base section 42 and the middle section 44 can be inflatable chambers having an inlet/outlet 48 and 50, respectively, through which air can pass. The top section 46 can be a hollow chamber having an inlet/outlet 52 through which a liquid (e.g., water) can pass. Thus, the base and middle sections 42, 44 can be filled with air, while the top section 46 can be filled with a liquid 54. The three sections 42, 44, 46 can be sized and configured so that the apparatus 40 will appear to be a unitary structure; for example, the sections 42, 44, 46 can have the same size and shape. The sections 42 and 44 can have the same construction (and materials) as the sections 22 and 26, and the section 46 can have the same construction (and materials) as the section 24. Each section 42, 44, 46 can be irremovably secured to an adjacent section 42, 44, 46 (e.g., by heat fusing, glue, and similar techniques), or removably secured to an adjacent section 42, 44, 46 (e.g., by VELCRO™ pads, ties, loops and similar devices).

The apparatus 40 can also be used like a conventional air mattress, with the added benefit that the top section 46 provides a more comfortable support for the back and body. In this regard, the top section 46 is filled with a liquid, which readily conforms to the user's body and provides the improved comfort when compared to a conventional air mattress. More significantly, the volume of the top section 46 can be small, so that only a small amount of liquid is needed to fill the chamber of the top section 46. As a result, the overall weight of the apparatus 40 when in use is significantly lighter than compared to a conventional water bed. In addition, the reduced volume makes it faster and more convenient for a user to fill up the top section 46 when compared to a conventional water bed that typically requires a larger volume of liquid. An additional benefit realized by the reduced volume of liquid is that accidental leakage or puncture of the top section 46 will not result in a serious flooding problem in the bedroom when compared to a conventional water bed that would normally flood a bedroom if it were to leak or puncture. Thus, the apparatus 40 provides the benefits (e.g., reduced firmness) of a conventional water bed while avoiding the drawbacks of conventional water beds (e.g., large volume of water needed, and flooding) and conventional air mattresses (e.g., too firm). These principles and benefits relating to the reduction of water volume and varying firmness apply to all the other embodiments as well.

Figure 5:
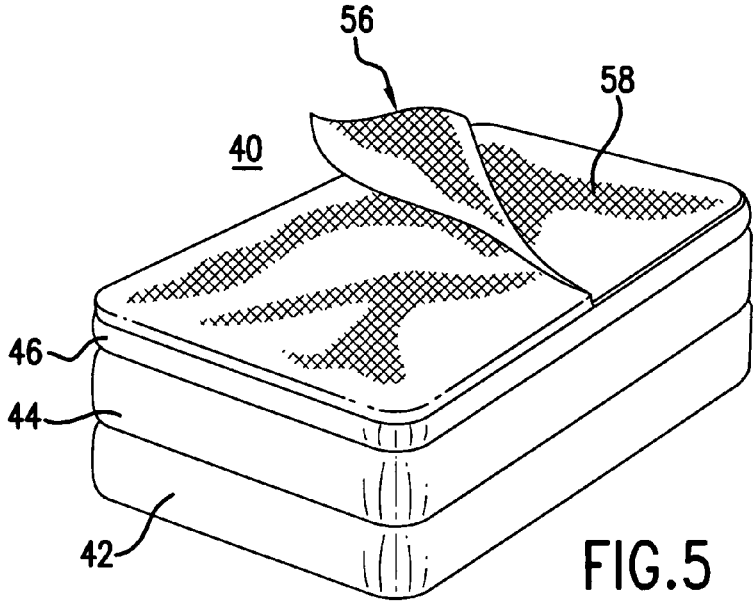
FIG. 5 is a perspective view of the apparatus of FIG. 3 shown with a cover and sleeping base added thereto.

FIG. 5 illustrates the addition of a cover 56 to the top of the top section 46 to function as a blanket. In addition, a soft sleeping base 58 can can be attached to the top of the top section 46 to provide the user with a comfortable surface to lie on. The cover 56 and the sleeping base 58 define a sleeping space therebetween for the user's body. The cover 56 can be stitched to two sides of the sleeping base 58 so that the combined cover 56 and sleeping base 58 actually forms a sleeping bag. The cover 56 and the sleeping 58 is preferably made from a soft cloth-like material, and can include soft paddings, down and any other conventional material that is typically used to provide sleeping bags with a soft and fluffy feel. The length of the cover 56 is shorter than the length of the sleeping base 58 so that the user can place his or her head on the exposed portion of the sleeping base 58.

The sleeping base 58 can be removably attached to the top section 46 by a removable attachment mechanism, such as opposing VELCRO™ pads provided on the bottom of the sleeping base 58 and the top of the top section 46. Other removable attachment mechanisms can be used, including but not limited to zippers, hooks and clasps, among others. Thus, the sleeping base 58 and the cover 56 can be removed so that the sleeping base 58 and the cover 56 can be washed.

The apparatus 40 can be easily and conveniently packed for storage by removing the sleeping base 58 and the cover 56 from the top section 46, and then folding the base 58 and the cover 56 in the same manner as folding a conventional sleeping bag. The liquid can then be emptied from the top section 46, and the middle section 44 and the base section 42 can be deflated. The sections 42, 44, 46 can then be folded into a small configuration. For example, a pouch (not shown) can be provided for holding the folded components of the apparatus 40. The pouch can then be conveniently carried around by the user. These same techniques can be applied to any of the other embodiments disclosed herein.

Figure 6:
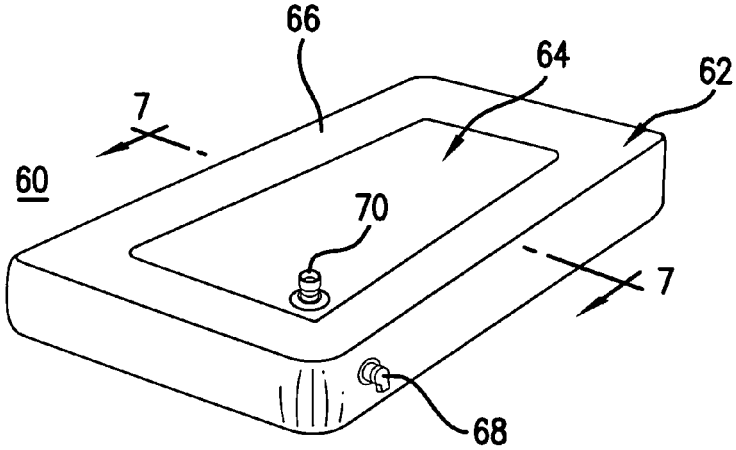
FIG. 6 is a perspective view of a portable bedding apparatus according to another embodiment of the present invention.
Figure 7:
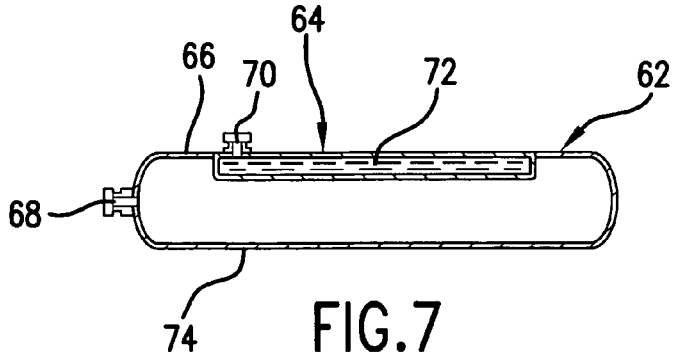
FIG. 7 is a cross-sectional view of the apparatus of FIG. 6 taken along lines 7—7 thereof.

FIGS. 6 and 7 illustrate yet another portable bedding apparatus 60 according to another embodiment of the present invention. The apparatus 60 is similar to the apparatus 40 in FIGS. 3–5 and applies the same principles as the apparatus in FIGS. 1–5, but the configurations have been modified to provide different functionalities and results. The apparatus 60 has an outer base section 62 and a top inner section 64. The base section 62 can be an inflatable chamber having an inlet/outlet 68 through which air can pass. The top section 64 can be a hollow chamber having an inlet/outlet 70 through which a liquid (e.g., water) can pass. Thus, the base section 62 can be filled with air, while the top section 64 can be filled with a liquid 72. As best shown in FIG. 7, the base section 62 has a base 74 and a surrounding wall 66 that defines a cavity region therein, with the top section 64 sized and configured to fit snugly inside the cavity region. The base section 62 can have the same construction (and materials) as the sections 22 and 26, and the top section 64 can have the same construction (and materials) as the section 24. The section 64 can be irremovably secured (e.g., by heat fusing, glue, and similar techniques), or removably secured (e.g., by VELCRO™ pads, ties, loops and similar devices), to the cavity region in the section 62.

The apparatus 60 can be used in the same manner as the apparatus 40 in FIGS. 3–5, and enjoys the same functions and benefits as the apparatus 40 in FIGS. 3–5, except that the apparatus 60 only provides one air-inflatable section, and provides an air-inflatable surrounding wall 66 for the liquid-filled top section 64. The surrounding wall 66 provides additional protection for the top section 64.

Figure 8:
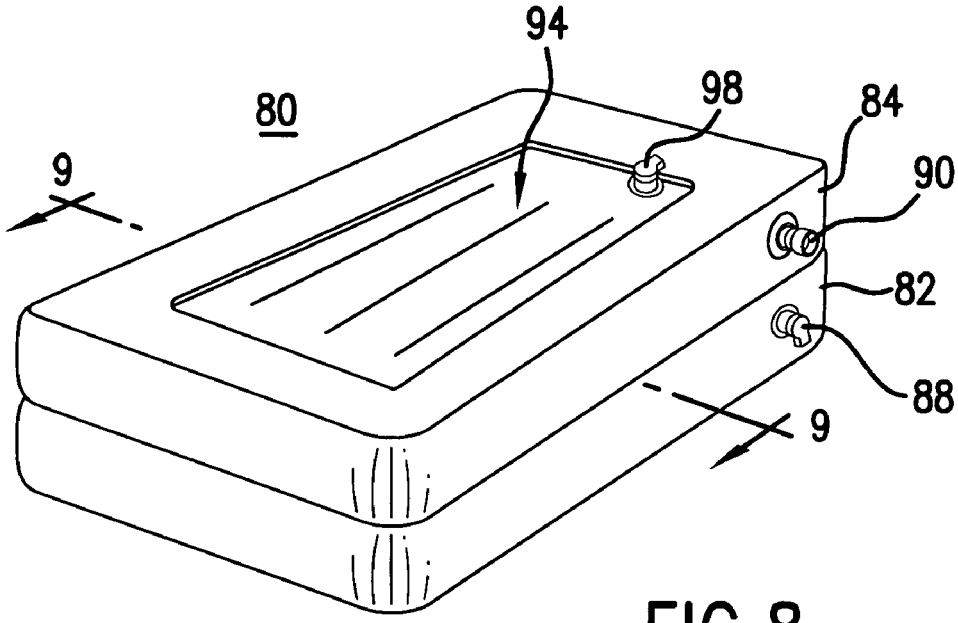
FIG. 8 is a perspective view of a portable bedding apparatus according to yet another embodiment of the present invention.
Figure 9:
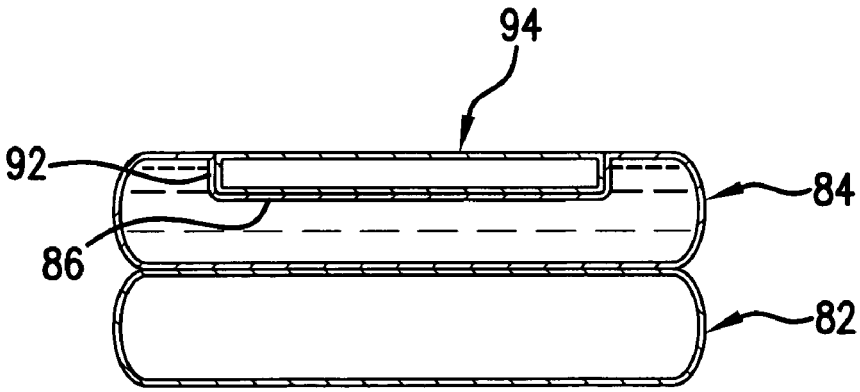
FIG. 9 is a cross-sectional view of the apparatus of FIG. 8 taken along lines 9—9 thereof.

FIGS. 8 and 9 illustrate another portable bedding apparatus 80 according to another embodiment of the present invention. The apparatus 80 is similar to the apparatus 40 and 60 in FIGS. 3–7 and applies similar principles. The apparatus 80 has a base section 82 and a top section 84. The base section 82 can be an inflatable chamber having an inlet/outlet 88 through which air can pass. The top section 84 can be a hollow chamber having an inlet/outlet 90 through which a liquid (e.g., water) can pass. The sections 82, 84 can be sized and configured so that the apparatus 80 will appear to be a unitary structure; for example, the sections 82, 84 can have the same size and shape. The top section 84 has a base 86 and a surrounding wall 92 that defines a cavity region therein, with an inner section 94 sized and configured to fit snugly inside the cavity region. The inner section 94 can be an inflatable chamber having an inlet/outlet 98 through which air can pass. The base section 82 and the inner section 94 can have the same construction (and materials) as the sections 42 and 44, and the top section 84 can have the same construction (and materials) as the section 46. The sections 82, 84 and 94 can be irremovably secured (e.g., by heat fusing, glue, and similar techniques), or removably secured (e.g., by VELCRO™ pads, ties, loops and similar devices), to each other.

The apparatus 80 can be used in the same manner as any of the other apparatus 20, 40, 60, and enjoys the same functions and benefits as these apparatus 20, 40, 60. The apparatus 80 borrows some of the principles from the apparatus 20 in FIGS. 1–2 (e.g., having an air-inflatable section at the very top) and the apparatus 60 in FIGS. 6–7 (e.g., providing a surrounding wall 84 for the section 94), and nicely illustrates how the various concepts and configurations of these embodiments can be modified and applied to create different embodiments.

Figure 10:
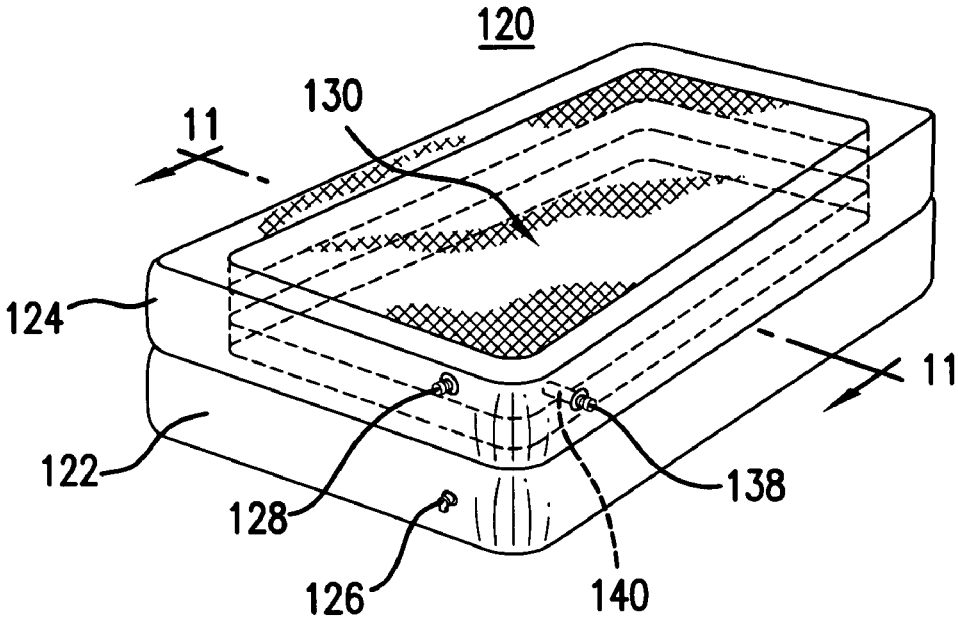
FIG. 10 is a perspective view of a portable bedding apparatus according to yet a further embodiment of the present invention.
Figure 11:
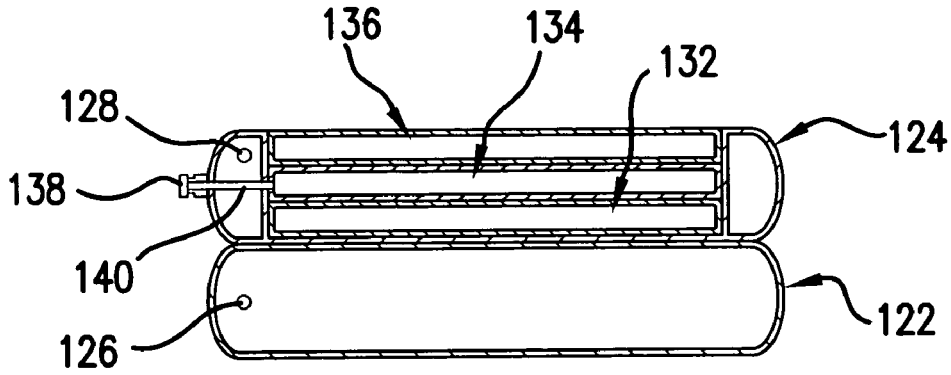
FIG. 11 is a cross-sectional view of the apparatus of FIG. 11 taken along lines 11—11 thereof.

FIGS. 10 and 11 illustrate another portable bedding apparatus 120 according to another embodiment of the present invention. The apparatus 120 is similar to the apparatus 60 and 80 in FIGS. 6–9 and applies similar principles. The apparatus 120 has a base section 122 and an upper wall section 124. Each section 122, 124 can be a hollow chamber that can receive and retain air or a liquid (e.g., water). Inlets/outlets 126 and 128 are provided in the sections 122 and 124, respectively, to allow air or liquid to pass therethrough. The sections 122, 124 can be sized and configured so that the apparatus 120 will appear to be a unitary structure; for example, the sections 122, 124 can have the same outer size. The wall section 124 is ring-like in that it forms an inner space 130 which receives one or more inner sections 132, 134, 136 snugly therein, one on top of the other. Inlets/outlets 138 can be provided for each of these inner sections 132, 134, 136 to allow liquid or air to be introduced into the section. These inlets/outlets 138 can extend through bores 140 provided in the wall section 124. The sections 122, 124, 132, 134, 136 can have the same construction (and materials) as any of the sections 42, 44 and 46 above. The sections 122, 124, 132, 134, 136 can be irremovably secured (e.g., by heat fusing, glue, and similar techniques), or removably secured (e.g., by VELCRO™ pads, ties, loops and similar devices), to each other. Each inner section 132, 134, 136 can be a hollow chamber that can receive and retain air or a liquid (e.g., water). For example, one or more of the inner sections 132, 134, 136 (e.g., the top inner section 136) can be filled with liquid, while the other inner sections can be filled with air. The provision of three separate inner sections 132, 134, 136 (one on top of the other) allows for the firmness to be adjusted to a greater degree than the other embodiments set forth hereinabove. For example, filling one inner section (e.g., 134) with a liquid will provide a firmer sleeping support than filling two inner sections (e.g., 132, 136) with a liquid.

The apparatus 120 can be used in the same manner as any of the other apparatus 20, 40, 60 and 80, and enjoys the same functions and benefits as these apparatus 20, 40, 60 and 80. The apparatus 120 also borrows some of the principles from the apparatus 60 and 80 in FIGS. 6–9 (e.g., providing a surrounding wall 124 for the inner sections 132, 134, 136).

Figure 12:
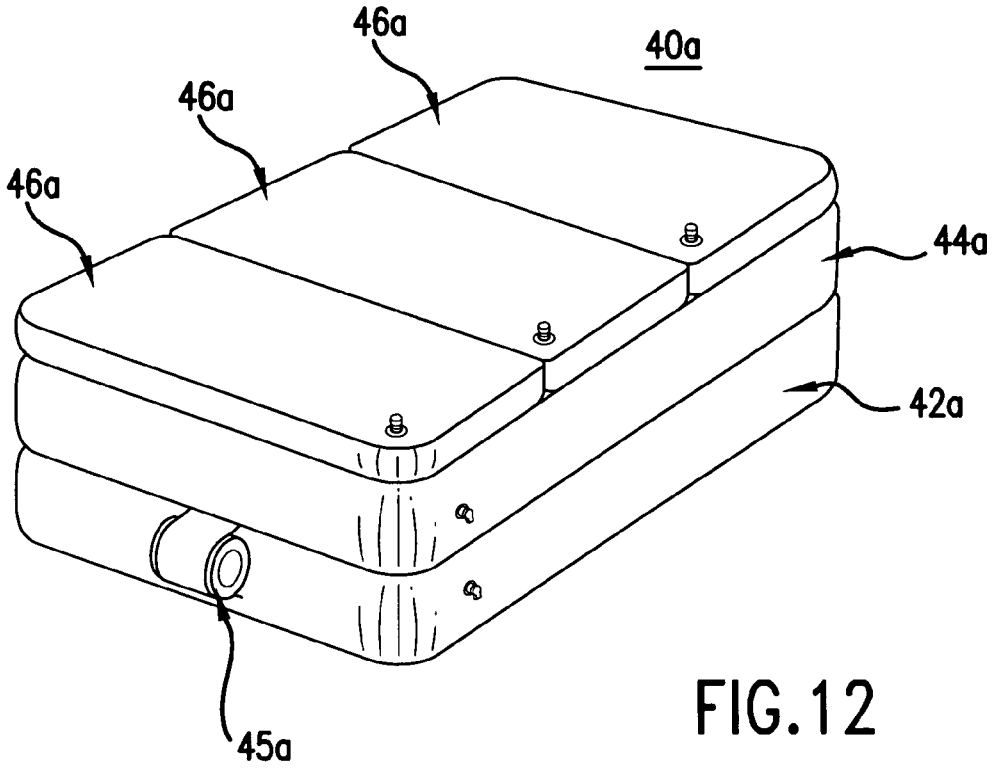
FIGS. 12–14 are perspective views of portable bedding apparatus according to further embodiments of the present invention.

FIG. 12 illustrates a portable bedding apparatus 40*a* that is similar to the apparatus 40 in FIGS. 3 and 4. The apparatus 40*a* also has two sections 42*a* and 44*a* that can be the same as the sections 42 and 44, respectively, in FIGS. 3 and 4, but the section 46 in FIGS. 3 and 4 is now replaced by a plurality of separate sub-sections 46*a*. Each sub-section 46*a* can be the same as the section 46, except that each sub-section 46*a* is provided in a smaller size. Each sub-section 46*a* is attached (e.g., by heat sealing or stitching) to a separate sub-section 46*a*. Each sub-section 46*a* has a separate internal chamber than can be adapted to retain air or a liquid. An air pump 45*a* can be provided to inflate and deflate the sections 42*a* and 44*a*.

If all the sub-sections 46*a* are filled with liquid, then the apparatus 40*a* can function in the same manner as the apparatus 40, with the primary difference being that the user can vary the firmness along the length of the apparatus 40 by varying the volume of liquid used to fill each sub-section 46*a*. For example, the user can choose to fill one of the end sub-sections 46*a* with less liquid so that the that particular sub-section 46*a* provides a firmer surface. This sub-section 46*a* can then be used for receiving a pillow, since it may be less comfortable to rest the head (via the pillow) on a very wavy or soft surface. In addition, by separating the entire volume of liquid needed to fill the section 46 in FIGS. 3–4 into a plurality of separate sub-sections 46*a*, the fact that each sub-section 46*a* retains less liquid would provide a slightly firmer sleeping surface throughout the length of the apparatus 40*a* when compared with the apparatus 40.

Figure 13:
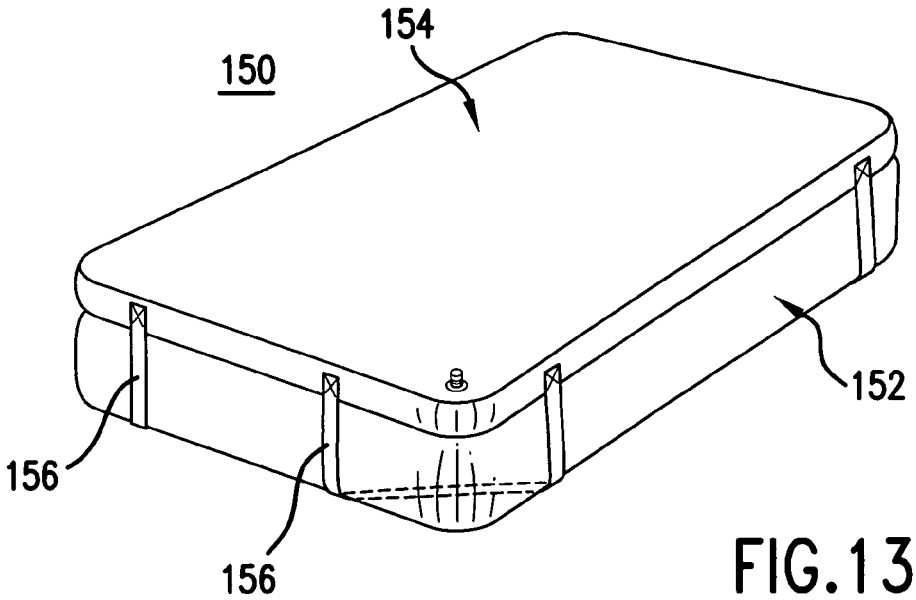

FIG. 13 illustrates a portable bedding apparatus 150 that is similar to the apparatus 40 in FIGS. 3 and 4. The apparatus 150 also has a top section 154 that can be the same as the top sections 46 in FIGS. 3 and 4, but the base section 152 in FIG. 13 can be either a section that is adapted to receive liquid or air, or a conventional mattress, or a conventional mattress box spring, or a foam block. In fact, it is possible to replace any of the air-filled sections described herein with a foam block section. If the base section 152 is a conventional mattress or box spring, then this embodiment illustrates the use of the liquid-filled top section 154 to provide a more comfortable, compliant, and softer sleeping surface. A user can use the top section 154 with any conventional mattress or box spring depending on the user's desired comfort level, health needs, or whim. Straps 156 (elastic or non-elastic) can be secured to the corners of the top section 154, and each strap 154 (four in total) can be looped around the bottom of each corner of the base section 152. Instead of the straps 156, opposing VELCRO™ pads and other similar attachment mechanisms (as described above) can be used to removably attach the top section 154 and the base section 152 together.

Figure 14:
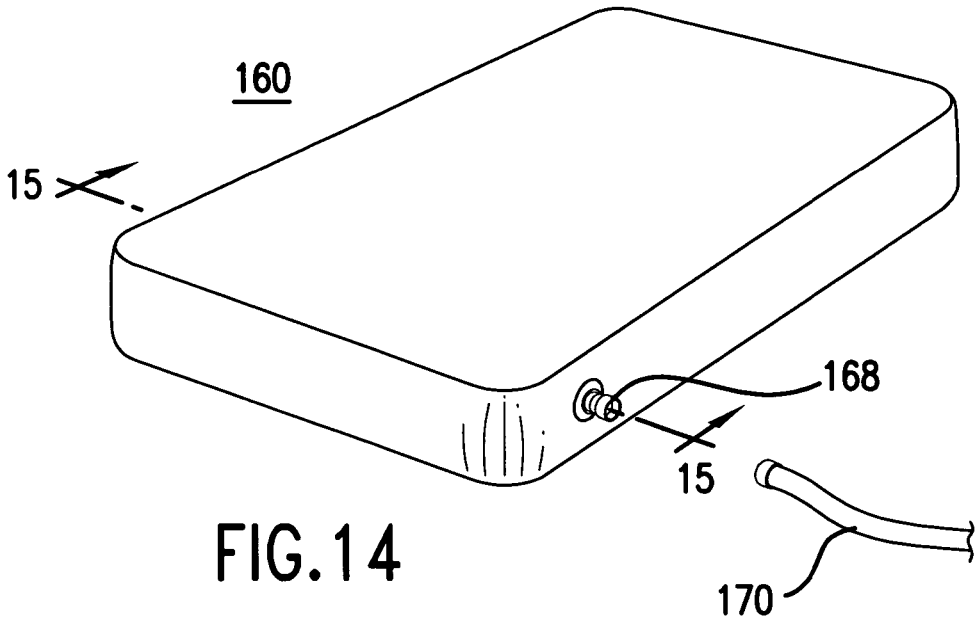
Figure 15:
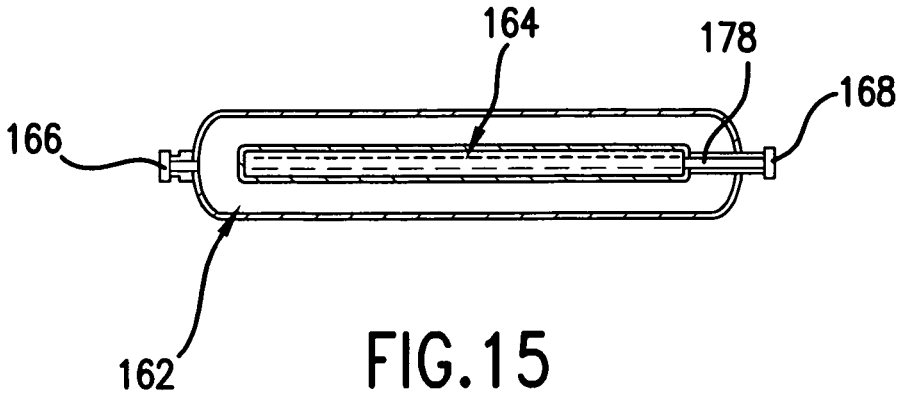
FIG. 15 is a cross-sectional view of the apparatus of FIG. 14 taken along lines 15—15 thereof.

FIGS. 14 and 15 illustrate another portable bedding apparatus 160 according to another embodiment of the present invention. The apparatus 160 has a main section 162, and a liquid section 164 retained inside the hollow interior of the main section 162. The main section 162 can be an inflatable chamber having an inlet/outlet 166, through which air can pass. The liquid section 164 can be a hollow chamber having an inlet/outlet 168 through which a liquid (e.g., water) can pass via a tubing 170. The inlet/outlet 168 can include a tube 178 that extends through the wall of the main section 162. The main section 162 can have the same construction (and materials) as the section 22, and the liquid section 164 can have the same construction (and materials) as the section 24.

Thus, the primary difference between the apparatus 160 and the other apparatus described hereinabove is that the liquid section 164 is retained inside the air-filled main section 162. Otherwise, the apparatus 160 can be used in the same manner as any of the other apparatus 20, 40, 60, 80, 120, 140 and 150, and enjoys the same functions and benefits as these apparatus 20, 40, 60, 80, 120, 140 and 150. Providing the liquid section 164 inside the main section 162 allows the sleeping surface of the main section 162 to be softened because the liquid section 164 imparts a wavy influence to the air retained inside the main section 162.

Figure 16:
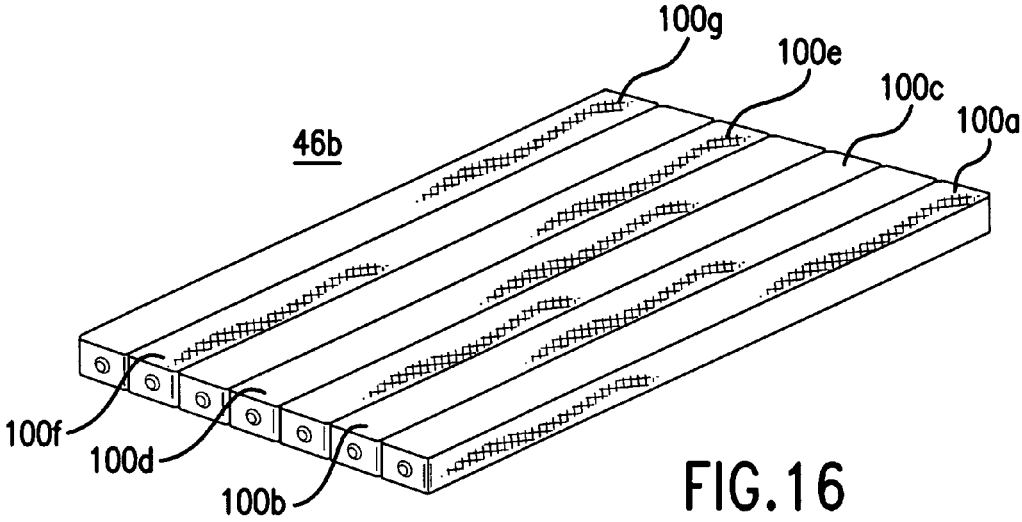
FIG. 16 is a perspective view of a portable bedding apparatus according to yet a further embodiment of the present invention.

FIG. 16 illustrates a modification that can be made to the top section 46 in FIGS. 3 and 4, and borrows from the principles illustrated in FIG. 12. The top section 46*b* in FIG. 16 can be separated into a plurality of side-by-side elongated segments 100*a*, 100*b*, 100*c*, 100*d*, 100*e*, 100*f*, 100*g*. Each elongated segment can be filled with either air or a liquid. For example, all the segments 100*a*, 100*b*, 100*c*, 100*d*, 100*e*, 100*f*, 100*g* can be filled with air, all the segments 100*a*, 100*b*, 100*c*, 100*d*, 100*e*, 100*f*, 100*g* can be filled with a liquid, or alternating segments can be filled with air (e.g., 100*a*, 100*c*, 100*e*, 100*g*) and a liquid (e.g., 100*b*, 100*d*, 100*f*). As another example, selected segments (e.g., 100*a* and 100*g*) can be filled with air while other segments (e.g., 100*b*, 100*c*, 100*d*, 100*e*, 100*f*) can be filled with a liquid to provide firmer sides and a softer and more compliant interior. Thus, the top section 46*b* provides a user with a considerable amount of flexibility in adjusting the comfort level and feel of the sleeping surface.

Figure 17:
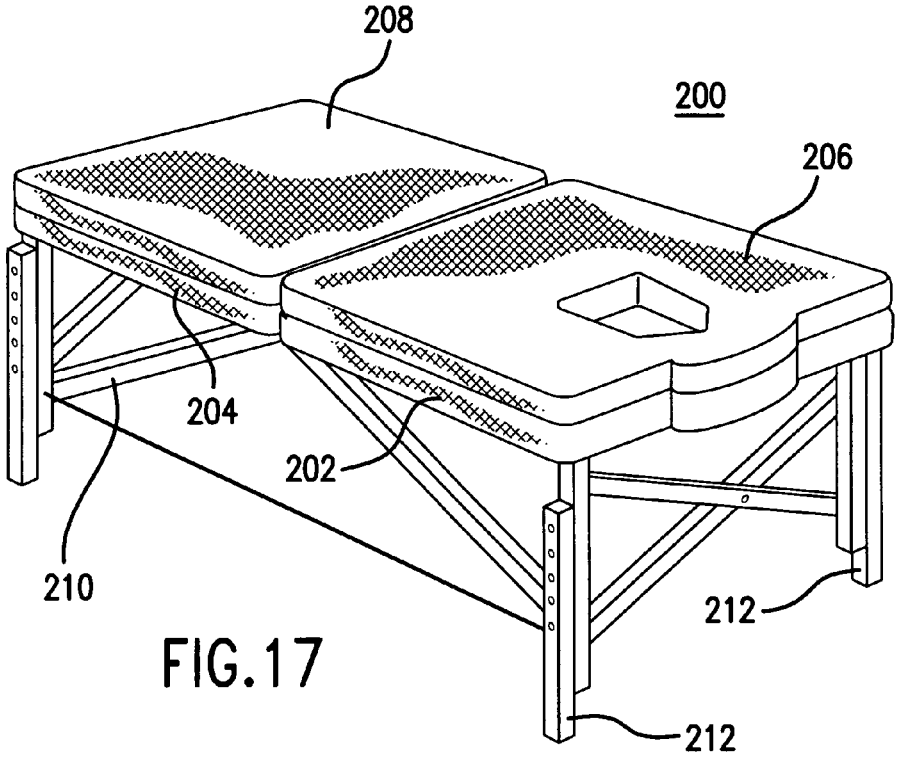
FIG. 17 is a perspective view of a portable massage table according to one embodiment of the present invention.

The principles of the present invention are not limited to the portable bedding apparatus described above, and can applied to numerous other furniture and similar items. As one non-limiting example, FIG. 17 illustrates a massage table 200 that has two base sections 202 and 204, each of which can be the same as the section 42 in FIGS. 3 and 4. The two base sections 202, 204 can be hingedly attached (e.g., by stitching) to each other. The massage table 200 also has two top sections 206 and 208, each of which can be the same as the top section 46 in FIGS. 3 and 4. The two top sections 206, 208 can also be hingedly attached (e.g., by stitching) to each other. In addition, the top sections 206 and 208 are positioned directly above the base sections 202 and 204, respectively. Applying the principles set forth in FIGS. 3–4, the top sections 206, 208 would retain a liquid and the base sections 202, 204 would retain air. The top section 206 and the base section 202 can be hingedly folded on top of the top section 208 and the base section 204 to store the massage table 200. The massage table 200 also has a folding frame 210 and legs 212 that are part of the folding frame 210.

Figure 18:
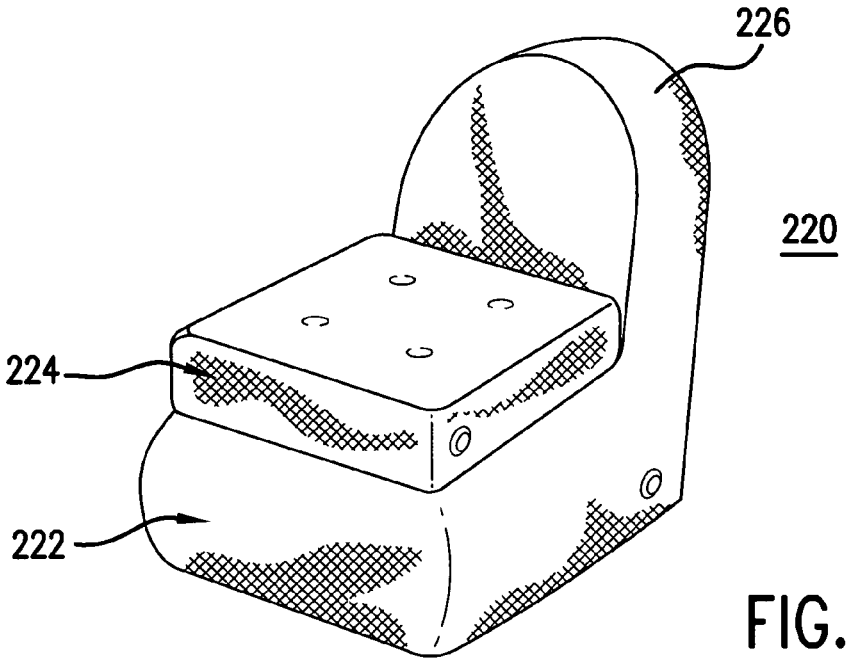
FIG. 18 is a perspective view of a chair according to one embodiment of the present invention.

FIG. 18 illustrates a chair 220 that has a base section 222 and a seating section 224. The base section 222 has a backrest 226 that extends from the rear of the base section 222 and contiguous thereto. The seating section 224 can be attached (either removably or irremovably) to the top of the base section 222 via any of the attachment mechanisms described above. The sections 222, 224 can have the same construction (and materials) as the sections 42 or 46 in FIGS. 3 and 4. In this embodiment, air or liquid can be filled into the sections 222, 224. For example, if air is filled into the base section 222 and its backrest 226, and a liquid is filled into the seating section 224, the chair 220 can provide similar functions and benefits as the embodiments set forth in FIGS. 3–12 above. It is also possible to fill air into the base section 222 and the seating section 224. Providing a liquid-filled seating section 224 will allow the user to have a somewhat softer (i.e., more compliant) seating surface.

Figure 19:
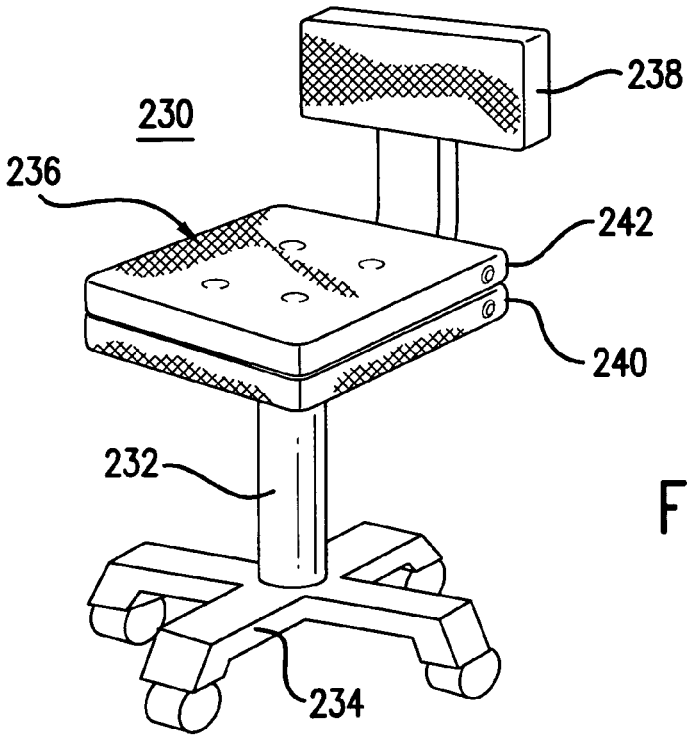
FIG. 19 is a perspective view of an office chair according to one embodiment of the present invention.

FIG. 19 illustrates an office chair 230 that has a conventional swivel base 232 and legs 234, a seat 236 and a backrest 238. The backrest 238 can be a conventional padded backrest, or it can be an inflatable backrest having the same construction as the section 42 in FIGS. 3–4. The seat 236 can be comprised of at least two sections, such as a base section 240 and a seating section 242 can be attached (either removably or irremovably) to the top of the base section 240 via any of the attachment mechanisms described above. The sections 240, 242 can have the same construction (and materials) as the sections 42 or 46 in FIGS. 3 and 4. As with the chair 220 in FIG. 18, air or liquid can be filled into the sections 240, 242. For example, if air is filled into the base section 240, and a liquid is filled into the seating section 242, the chair 230 can provide similar functions and benefits as the embodiments set forth in FIGS. 3–12 above. It is also possible to fill a liquid into the base section 240, and air into the seating section 242. Alternatively, both sections 240 and 242 can be filled with air, or with a liquid. Providing a liquid-filled seating section 242 will allow the user to have a somewhat softer (i.e., more compliant) seating surface.

Figure 20:
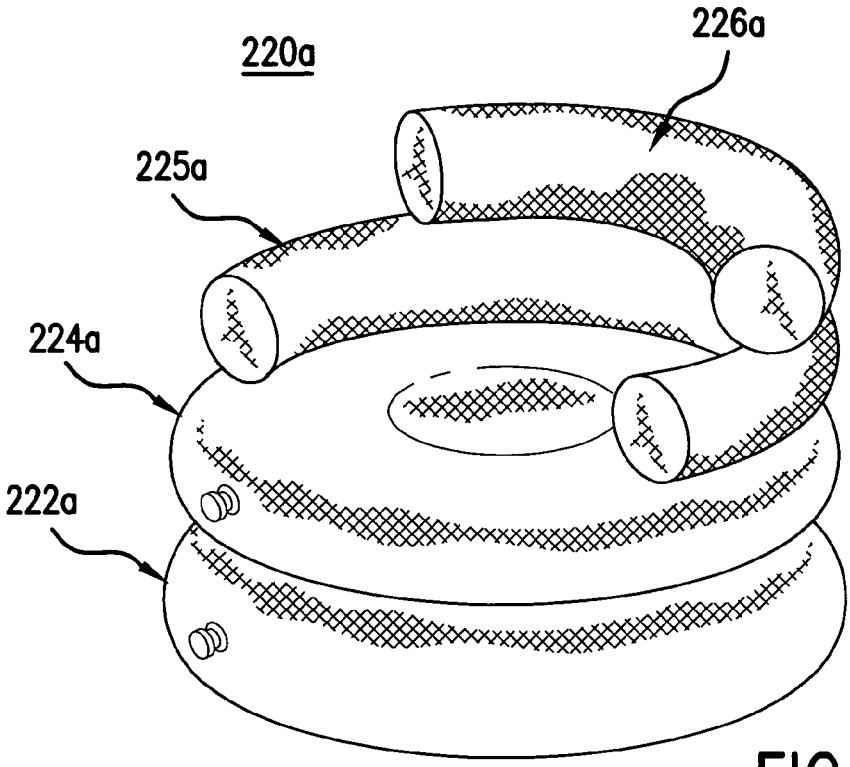
FIG. 20 is a perspective view of a sofa according to one embodiment of the present invention.

FIG. 20 illustrates a sofa 220*a* that is similar to the chair 220 in FIG. 18. The sofa 220*a* has a base section 222*a* and a seating section 224*a*. The base section 222*a* can have the same construction (and materials) as the section 42 in FIGS. 3 and 4. The seating section 224*a* can be attached (either removably or irremovably) to the top of the base section 222*a* via any of the attachment mechanisms described above. The seating section 224*a* can have the same construction (and materials) as the section 46 in FIGS. 3 and 4. A plurality of backrest sections 225*a* and 226*a* can be attached (either removably or irremovably) to the top rear edge of the seating section 224*a* via any of the attachment mechanisms described above. The lower backrest section 225*a* can be attached to the top of the seating section 224*a*, and the upper backrest section 226*a* can be attached to the top of the lower backrest section 225*a*. Each backrest section 225*a*, 226*a* can have the same construction (and materials) as the sections 42 or 46 in FIGS. 3 and 4. In this embodiment, air or liquid can be filled into the sections 222*a*, 224*a* as described above for the chair 220 of FIG. 18. In addition, the backrest sections 225*a*, 226*a* can be filled with either air or a liquid. For example, the lower backrest section 225*a* can be filled with a liquid and the upper backrest section 226*a* can be filled with air, or vice versa. Alternatively, all the backrest sections 225*a*, 226*a* can be filled with air, or with a liquid. Thus, by providing the backrest in the form of two or more backrest sections 225*a*, 226*a* that can retain either air or a liquid, the sofa 220*a* allows the user to adjust the comfort level and feel of the entire backrest.

Figure 21:
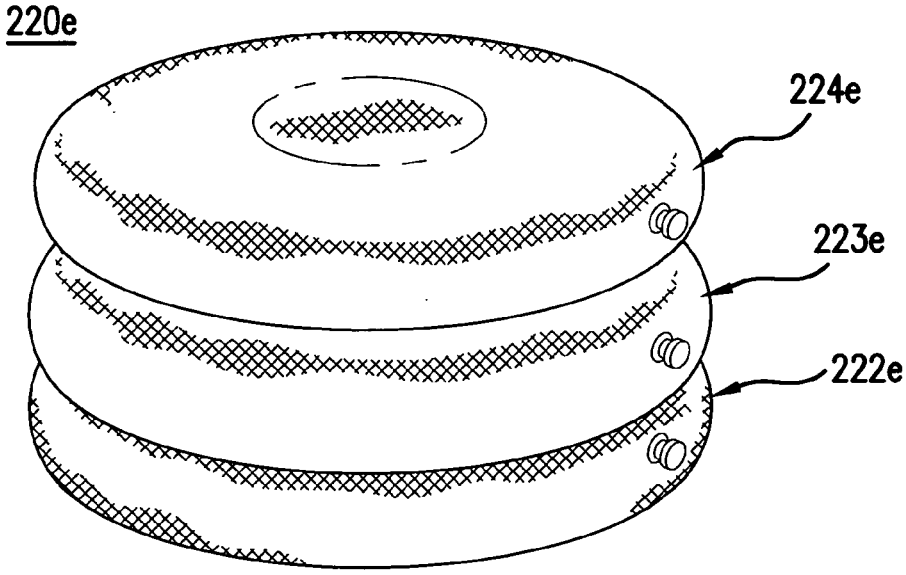
FIG. 21 is a perspective view of an ottoman or seat according to one embodiment of the present invention.

FIG. 21 illustrates an ottoman or seat 220*e* that is similar to the chair 220 in FIG. 18 and the sofa 220*a* in FIG. 20. The seat 220*e* has a base section 222*e*, an intermediate section 223*e*, and a seating section 224*e*. The sections 222*e*, 223*e*, 224*e* can have the same construction (and materials) as the sections 42 or 46 in FIGS. 3 and 4. The intermediate section 223*e* can be attached (either removably or irremovably) to the top of the base section 222*e*, and the seating section 224*e* can be attached (either removably or irremovably) to the top of the intermediate section 223*e*, via any of the attachment mechanisms described above. In this embodiment, air or liquid can be filled into the sections 222*a*, 223*e*, 224*a* as described above for the chair 220 of FIG. 18. For example, air can be filled into the sections 222*e* and 224*e*, with liquid filled into the section 223*e*. Alternatively, liquid can be filled into the sections 222*e* and 224*e*, with air filled into the section 223*e*. As another alternative, liquid can be filled into the section 224*e*, with air filled into the sections 222*e* and 223*e*. It is also possible to fill all sections 222*e*, 223*e*, 224*e* with air, or with a liquid.

Figure 22:
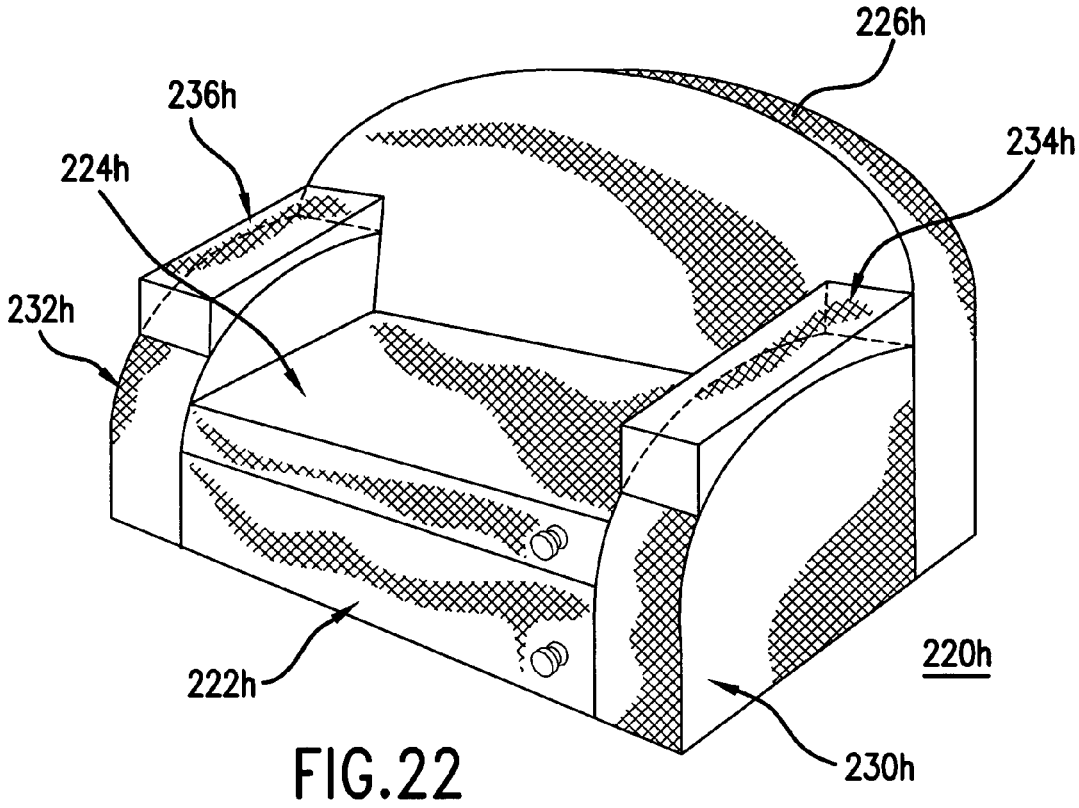
FIGS. 22–24 are perspective views of chairs according to other embodiments of the present invention.

FIG. 22 illustrates another chair 220*h* that is very similar to the chair 220 in FIG. 18. The chair 220*h* has a base section 222*h*, a seating section 224*h* and a backrest 226*h* that can be the same as the base section 222, the seating section 224 and the backrest 226 in FIG. 18. In addition, the chair 220*h* has two side arm sections 230*h* and 232*h* that can be irremovably secured (e.g., by heat fusing, glue, and similar techniques), or removably secured (e.g., by VELCRO™ pads, ties, loops and similar devices), to the sides of the base section 222*h*, the seating section 224*h* and the backrest 226*h*. These sidearm sections 230*h*, 232*h* can have the same construction (and materials) as the sections 42 or 46 in FIGS. 3 and 4, and air or liquid can be filled into the sidearm sections 230*h*, 232*h*. The chair 220*h* can also include arm rest sections 234*h* and 236*h* that can be attached (either removably or irremovably) to the top of the sidearm sections 230*h* and 232*h*, respectively. These arm rest sections 234*h*, 236*h* can have the same construction (and materials) as the section 46 in FIGS. 3 and 4, and are adapted to retain a liquid. The liquid-filled arm rest sections 234*h* and 236*h* provide a softer and more compliant surface for receiving the arms of a user, thereby increasing the comfort level to the user.

Figure 23:
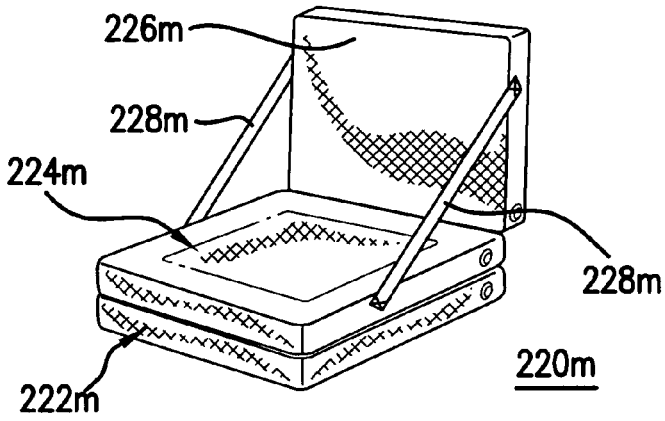

FIG. 23 illustrates another chair 220*m* that is very similar to the chair 220 in FIG. 18. The chair 220*m* is a foldable chair, and has a base section 222*m*, a seating section 224*m* and a backrest section 226*m* that is separate from the seating section 224*m*. The base section 222*m* and the seating section 224*m* can be essentially the same as the base section 222 and the seating section 224 in FIG. 18. The backrest section 226*m* is hingedly attached (e.g., by stitching) to the seating section 224*m*, and can have the same construction (and materials) as the sections 42 or 46 in FIGS. 3 and 4. Air or liquid can be filled into the backrest section 226*m*. The chair 220*m* can be folded for storage, or extended into the deployed position shown in FIG. 23 while being supported by side straps 228*m*.

Figure 24:
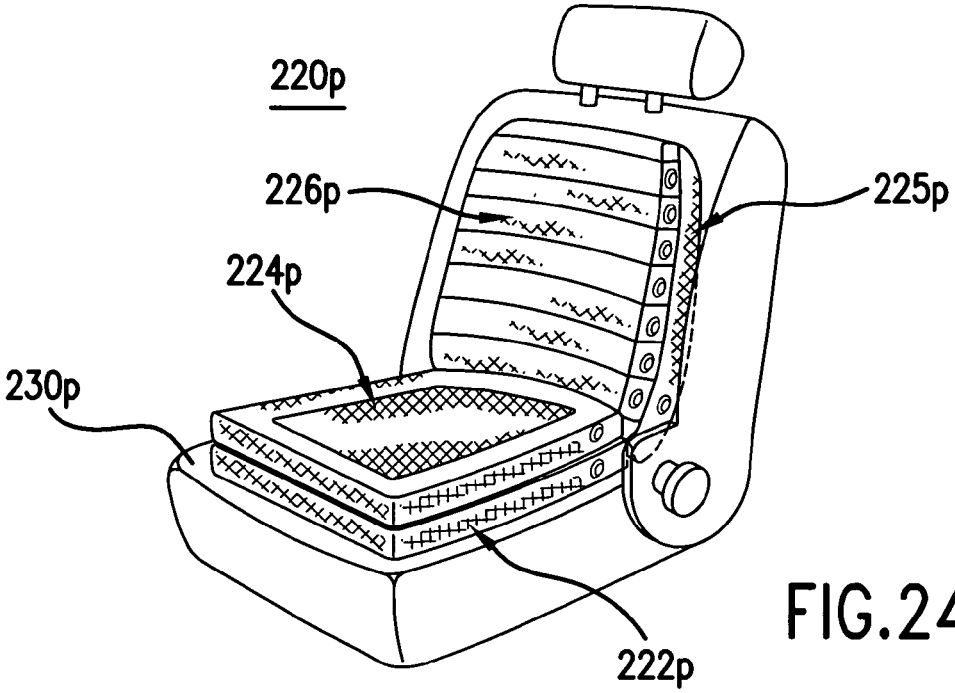

The car seat 220*p* in FIG. 24 further extends the principles in FIGS. 18–23. The car seat 220*p* is adapted to be used on a conventional vehicle seat 230*p* to provide the driver with improved comfort. The car seat 220*p* is very similar to the chair 220*m* in FIG. 23, and has a base section 222*p*, a seating section 224*p*, an inner backrest section 225*p*, and an outer backrest section 226*p*. The backrest sections 225*p* and 226*p* are separate from the base section 222*p* and the seating section 224*p*. The base section 222*p* and the seating section 224*p* can be the same as the base section 222 and the seating section 224 in FIG. 18. The backrest sections 225*p* and 226*p* can be hingedly attached (e.g., by stitching) to the base section 222*p* and seating section 224*p*, and can have the same construction (and materials) as the sections 42 or 46 in FIGS. 3 and 4. Air or liquid can be filled into the backrest sections 225*p* and 226*p*. For example, air can be filled in the base section 222*p* and the inner backrest section 225*p*, with a liquid filled in the seating section 224*p* and the outer backrest section 226*p*. Filling the seating section 224*p* and the outer backrest section 226*p* with a liquid will provide both the seating surface and the backrest surface with a softer (i.e., more compliant) seating surface.

Figure 25:
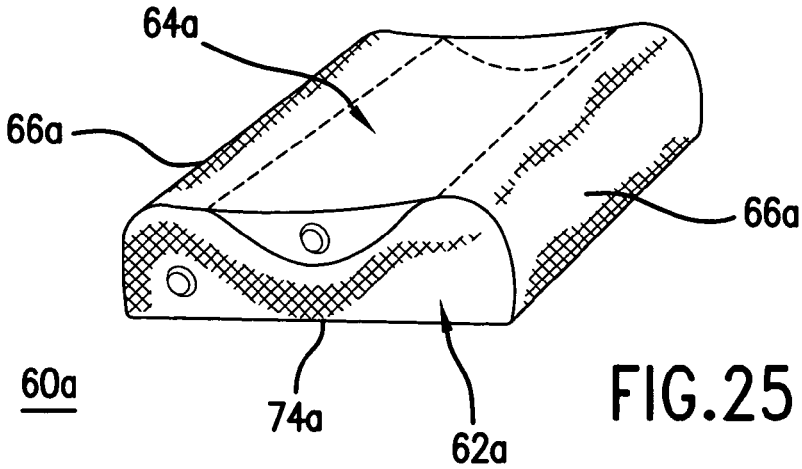
FIG. 25 is a perspective view of a pillow according to one embodiment of the present invention.

The principles of the present invention are applicable to a wide variety of products. For example, the bedding apparatus shown in FIGS. 1–15 can be used as a pet mattress. As another example, FIG. 25 illustrates a pillow 60*a* that has the same general construction as the apparatus 60 in FIGS. 6–7. The pillow 60*a* has an outer base section 62*a* and a top inner section 64*a* that can have the same construction and materials as the base section 62 and the top section 64 in FIGS. 6–7. Thus, the base section 62*a* can be filled with air, while the top section 64*a* can be filled with a liquid. The base section 62*a* has a base 74*a* and two longitudinal walls 66*a* that defines a concave region therebetween, with the top section 64*a* sized and configured to fit snugly inside the concave region. The section 64*a* can be irremovably secured (e.g., by heat fusing, glue, and similar techniques), or removably secured (e.g., by VELCRO™ pads, ties, loops and similar devices), to the concave region in the section 62*a*.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An apparatus, comprising:

a first section having a top and a bottom, and a hollow interior that is filled with air;

a second section attached to the top of the first section and having a hollow interior that retains a liquid; and a third section attached to the bottom of the first section and having a hollow interior that is filled with air.

2. The apparatus of claim 1, wherein the first and second sections have the same size and shape.

3. The apparatus of claim 1, wherein the third section has the same size and shape as the first and second sections.

4. The apparatus of claim 1, wherein the second section has a top surface, and further including a cover attached to the top surface of the second section.

5. The apparatus of claim 1, wherein the second section comprises a plurality of separate sub-sections that are connected to each other.

6. The apparatus of claim 1, further including means for removably coupling the second section to the top of the first section.

7. The apparatus of claim 1, wherein the second section comprises a plurality of side-by-side elongated segments.

8. The apparatus of claim 1, wherein the first section comprises a first plurality of separate sub-sections that are hingedly connected to each other, and the second section comprises a second plurality of separate sub-sections that are hingedly connected to each other.

9. The apparatus of claim 1, further including a backrest extending from the first section.

10. The apparatus of claim 9, wherein the backrest comprises a plurality of separate backrest sections attached on top of each other, with each backrest section having a hollow interior that either is filled with air or retains a liquid.

11. The apparatus of claim 1, further including an arm rest section having a hollow interior that either is filled with air or retains a liquid.

12. An apparatus, comprising:

a first section having a top, and a hollow interior that is filled with air;

a second section attached to the top of the first section and having a hollow interior that retains a liquid, the second section having a top; and a third section attached to the top of the second section and having a hollow interior that is filled with air;

wherein the third section has the same size and shape as the first and second sections.

13. An apparatus comprising:

a first section having a top and a bottom, and a hollow interior that is filled with air;

a second section attached to the top of the first section and having a hollow interior that retains a liquid; and a third section attached to the bottom of the first section and having a hollow interior that is filled with air;

wherein the first section has a base and a surrounding wall that defines a cavity region therein, with the second section retained inside the cavity region.

* * * * *